United States Patent [19]

Hayashi et al.

[11] Patent Number: 4,512,177

[45] Date of Patent: Apr. 23, 1985

[54] METHOD OF MANUFACTURING METALLIC MATERIALS HAVING A CIRCULAR CROSS SECTION

[75] Inventors: Chihiro Hayashi; Kazuyuki Nakasuji, both of Amagasaki, Japan

[73] Assignee: Sumitomo Metal Industries, Ltd., Osaka, Japan

[21] Appl. No.: 508,720

[22] Filed: Jun. 28, 1983

[30] Foreign Application Priority Data

Jun. 30, 1982 [JP] Japan ..... 57-114362
Feb. 10, 1983 [JP] Japan ..... 58-20753

[51] Int. Cl.[3] ..... B21B 27/02

[52] U.S. Cl. ..... 72/368; 29/527.7; 72/78; 72/96; 72/377

[58] Field of Search ..... 72/68, 78, 95, 96, 97, 72/100, 368, 377, 98; 29/527.7

[56] References Cited

U.S. PATENT DOCUMENTS 3,503,238 3/1970 Marcovitch ..... 72/96
3,550,417 12/1970 McMaster ..... 72/377
4,202,195 5/1980 Tuschy et al. ..... 72/78

FOREIGN PATENT DOCUMENTS 46-43980 12/1971 Japan .
57-91806 6/1982 Japan .

OTHER PUBLICATIONS

"*Sosei to Kakov*", (Plasticity and Working), vol. 7, No. 67, (Aug. 1966).
"Study on Helical Rolling", Sosei to Kakov, vol. 10, No. 104, (Sep. 1969).

*Primary Examiner*—W. D. Bray
*Attorney, Agent, or Firm*—Burns, Doane, Swecker & Mathis

[57] ABSTRACT

The invention relates to a method of manufacturing solid metallic materials having a circular cross section by employing a rotary mill. A three or four roll cross-type rotary mill is employed, with cross and feed angle setting selected so as to meet specific conditions. The method permits efficient production of metallic materials without internal cracks or internal fracture initiated from porosity. In one version of the method the material being worked is rotated. In another version the material is not rotated and the roll housing is rotated around the former. Where the latter version is employed, it is possible to work the material as produced by a continuous casting machine and without cutting.

14 Claims, 39 Drawing Figures

20
22
23
21
X
Y
O
β
A

METHOD OF MANUFACTURING METALLIC MATERIALS HAVING A CIRCULAR CROSS SECTION

BACKGROUND OF THE INVENTION (1) Field of the Invention

The present invention relates to a method of manufacturing metallic materials having a circular cross section, such as round steel bars, rods and the like, by employing a rotary mill.

(2) Description of the Prior Art

Round steel bars are generally manufactured through the stage of rolling by caliber rolls. Recently, there have been attempts to employ a rotary mill in round steel-bar manufacturing, with a view to economizing equipment cost.

An "inclined-roll type rotary mill" disclosed in Japanese Patent Publication No. 43980 of Showa 46 is well known as a high-performance rolling mill which can efficiently reduce solid materials in one-pass operation. FIG. 1 is a front view of such rotary mill as seen from the work piece 10 outlet side. FIG. 2 is a section taken along the line II—II in FIG. 1. FIG. 3 is a side view showing feed angle $\beta$. The mill comprises three one-end-supported cone-type rolls 11, 12 and 13 (whose axes are each designated Y—Y) adapted to be rotated around a pass line X—X in conjunction with a roll housing (not shown), each roll having a substantially larger diameter on the work piece 10 inlet side than that on the work piece outlet side. In said publication there is no specific mention about cross angle $\gamma$ ($\alpha$ in the publication), an important factor in the present invention, but apparently the roll arrangement is such that cross angle $\gamma$ is variable between $-50°$ and $-60°$. (Note: Cross angle $\gamma$ is expressed in positive terms where the shaft ends on one side of the rolls stay close to the work piece 10 on the inlet side therefor, and in negative terms where they stay close to the work piece 10 on the outlet side therefor.) Whilst, feed angle $\beta$ is variable from 3° to 6°. With such roll arrangement, said rotary mill is claimed to be advantageous in that shear strain due to surface twist, if any, caused to the work piece is insignificant. However, experiments made by the present inventors showed that such roll arrangement would not permit any meaningful correction of internal defects such as porosity and the like and would produce considerable circumferential shear strain, it being thus unsuitable for the purpose of manufacturing high-quality round steel bars.

In "Plasticity and Working" (a journal published in Japan), Vol. 7, No. 67 and Vol. 10, No. 104, there appeared an article entitled "Study on Helical Rolling" in two parts, No. 1 and No. 2, which dealt with a rolling method wherein both-end-supported three cone-type rolls 21, 22, 23 arranged around work piece 20 are rotated to roll the work piece 20 while the latter being rotated simultaneously, as shown in FIGS. 4 to 6 presented similarly to FIGS. 1 to 3 (except that FIG. 4 shows the roll arrangement as seen from the inlet side for the work piece 20), and which reported on the results of experiments with a roll arrangement wherein cross angle $\gamma$ is 0° and feed angle $\beta$ is $0° \sim 14°$. Apparently, this roll arrangement may cause less shear strain in the circumferential direction as compared with the previously mentioned known arrangement, whereas possible shear strain due to surface twist may be greater. According to the results of experiments also conducted by the present inventors with this arrangement, no satisfactory correction of internal defects such as porosity is achievable. Further, it has been found that rolling efficiency with such arrangement is low and that forward tensile force should be applied.

As above mentioned, conventional round steel bar manufacturing methods employing a helical rolling mill involve a number of problems yet to be solved, and indeed they are still far from practical application.

Apart from such problems, there has been a demand that, in order to increase production efficiency, cast pieces produced by a continuous casting machine or steel blooms produced by a blooming mill be directly fed, without being cut, to a rotary mill for elongation. If such demand is to be met, it is necessary that the work piece should be allowed to remain unrotated. For this purpose there has been proposed a rotary mill having such inclined roll arrangement as shown in FIGS. 7 to 9 (Japanese Patent Kokai No. 91806 of Showa 57). FIG. 7 is a front view showing the roll arrangement of such rotary mill. FIG. 8 is a section taken along the line VIII—VIII in FIG. 7. FIG. 9 is a side view taken on the line IX—IX in FIG. 7. In the figures, the reference numeral 10' designates a work piece, and 11', 12' and 13' designate three one-end-supported cone-type rolls. Work piece 10' is moved along a pass line X—X in the direction of larger arrow. The cone-type rolls 11', 12' and 13' are axially supported in a roll housing (not shown) adapted to be rotated around the pass line X—X, their individual axes Y—Y being inclined at an angle $\gamma$ (cross angle) relative to the pass line X—X and at an angle $\beta$ (feed angle) in the circumferential direction of the pass line X—X, with the smaller-diameter-side ends of the rolls 11', 12' and 13' directed toward the downstream side of the path of movement of the work piece 10', so that the individual cone-type rolls may be rotated on their respective axes and around the pass line X—X to roll the work piece 10'. The angle setting of the rolls 11', 12' and 13' is usually such that cross angle $\gamma$ is at $-50°$ to $-60°$ (in which connection it is noted that cross angle $\gamma$ is expressed in positive terms where the shaft ends on one side of the rolls stay close to the work piece 10' on the inlet side therefor, and in negative terms where they stay close to the work piece 10' on the outlet side therefor), while feed angle $\beta$ is at 3° to 6°.

However, experiments made by the present inventors have revealed that while the method has an advantage in that materials rolled in accordance therewith involve no much shear strain due to surface twist, the possibility of its contribution toward correction of internal defects such as porosity and the like is doubtful. It has also been found that the method does not permit any meaningful rolling efficiency, nor does it provide any sufficient dimensional accuracy as to the outside diameter of the product.

OBJECTS AND BRIEF SUMMARY OF THE INVENTION

The present invention has been made in view of the state of the prior art and problems involved therein as above described.

Accordingly, it is an object of the invention to provide a method of manufacturing metallic materials having a circular cross section which permits high reduction and substantially high production efficiency.

It is another object of the invention to provide a method of manufacturing circular cross-section metallic materials which is less liable to cause circumferential shear strain and which involves no possibility of internal cracks initiating from inclusions under shear stress, even when a less workable material (having low thermal deformability) is being worked.

It is still another object of the invention to provide a method which permits high-efficiency manufacture of circular-section metallic materials from billets (which generally have center porosity) produced by continuous casting; more specifically, a method which makes it possible to manufacture circular-section metallic materials from continuously cast billets by a rotary mill in such manner that circumferential shear strain is reduced to prevent possible internal fractures initiated from porosities, or so-called Mannesmann fracture and that porosities are consolidated (vanished) and minimized through sufficient rolling.

It is a further object of the invention to provide a method which permits high-reduction working of less workable materials and which is adapted for direct connection with continuous casting and/or other rolling operations to permit efficient production of high-quality metallic materials having a circular cross section.

Hence, the present invention provides a method of manufacturing metallic materials having a circular cross section, which includes the steps of producing a solid bar-form material having a circular or hexagonal or more polygonal cross section and elongating the material into a circular cross-section solid material by reducing the diameter thereof, characterized in: that a rotary mill is employed in said elongating step (wherein the material being worked is rotated), said rotary mill comprising three or four rolls arranged around a pass line for the material being worked, the axes of the rolls being inclined or adapted to be inclined so that the shaft ends on the material inlet side of the rolls stay close to the pass line at a cross angle $\gamma$, said axes being inclined at a feed angle $\beta$ so that the shaft ends on same side of the rolls face same circumferential side of the material being worked, said rolls being supported at their respective both ends, and that said cross and feed angles are set within the following ranges:

$$0^\circ < \gamma < 15^\circ$$

$$3^\circ < \beta < 20^\circ$$

$$5^\circ < \gamma + \beta < 30^\circ.$$

The invention also provides a method of manufacturing metallic materials having a circular cross section, which includes the steps of producing a solid bar-form material having a circular or hexagonal or more polygonal cross section and elongating the material into a circular cross-section solid material by reducing the diameter thereof, characterized in: that a rotary mill is employed in said elongating step (wherein the material being worked is not rotated), said rotary mill comprising three or four rolls adapted to rotate on their respective shafts and disposed in a housing adapted to rotate around a pass line for the material being worked, the axes of the rolls being inclined or adapted to be inclined so that the shaft ends on the material inlet side of the rolls stay close to the pass line at a cross angle $\gamma$, said axes being inclined at a feed angle $\beta$ so that the shaft ends on same side of the rolls face same circumferential side of the material being worked, and that said cross and feed angles are set within the following ranges:

$$0^\circ < \gamma < 60^\circ$$

$$3^\circ < \beta < 45^\circ$$

The above and further objects and features of the invention will more fully be apparent from the following detailed description with the accompanying drawings.

DETAILED DESCRIPTION OF THE INVENTION

The method of the present invention will now be described in more detail, first with respect to a version in which a work piece or material being worked is rotated.

Figure 12:
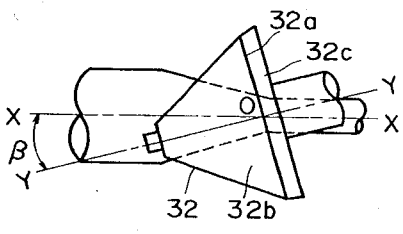
FIG. 12 is a side view showing a feed angle $\beta$ therein.
Figure 11:
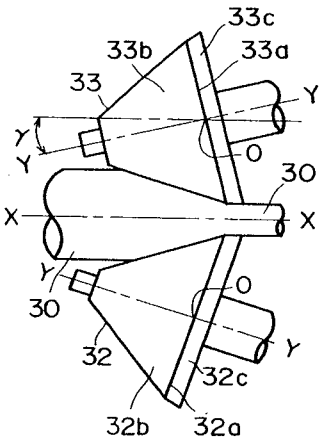
FIG. 11 is a section taken on the line XI—XI in FIG. 10.
Figure 10:
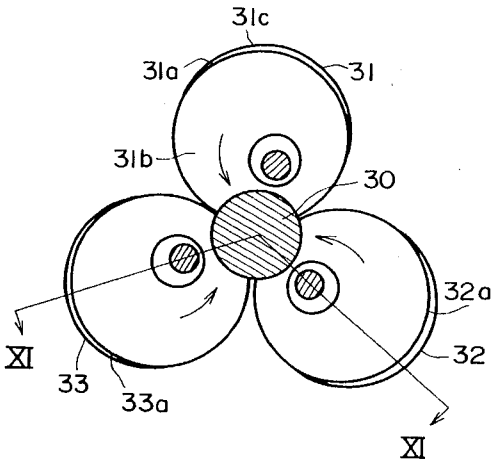
FIG. 10 is a schematic view in front elevation showing the construction of a rotary mill employed in working the method of the present invention.
Figure 14:
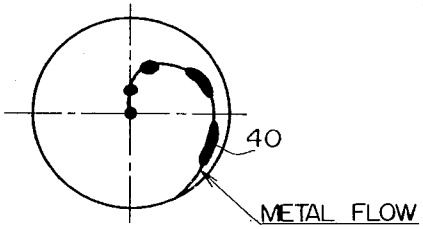
FIG. 14 is a section showing a post-rolling configuration thereof by way of example.

FIG. 10 is a front view showing the work piece 30 being rolled, as seen from the work piece inlet side, where a three roll arrangement is employed in accordance with the invention. FIG. 11 is a section taken on the line XI—XI in FIG. 10, and FIG. 12 is a side view showing a feed angle $\beta$ used in the roll arrangement. The three rolls 31, 32 and 33 have gorges 31*a*, 32*a* and 33*a* respectively adjacent their ends on the work piece outlet side. With the gorge as a border, each roll has its diameter reduced straightforwardly toward its shaft end on the work piece inlet side and has its diameter enlarged in a straight-line or curved-line pattern or the work piece outlet side. Therefore, the rolls 31, 32 and 33 are of substantially truncated cone shape and have inlet surfaces 31*b*, 32*b* and 33*b* and outlet surfaces 31*c*, 32*c* and 33*c*. The rolls 31, 32 and 33 are arranged in such a way that their inlet surfaces 31*b*, 32*b* and 33*b* are disposed on the upstream side of the path of movement of the work piece 30 and that intersecting points O between the roll axes Y—Y and a plane including the gorges 31*a*, 32*a* and 33*a* (said intersecting points O to be hereinafter referred to as roll setting centers; similarly shown in FIGS. 1 to 6 as well) are positioned in substantially equal spaced relation around the pass line X—X and on a plane intersecting orthogonally with the pass line X—X. Axes Y—Y of the rolls 31, 32 and 33 are crossed (inclined) at a cross angle $\gamma$ at their respective roll setting centers O relative to the pass line X—X so that their front shaft ends stay close to the pass line X—X as FIG. 11 shows, and at same time their front shaft ends are inclined at a feed angle $\beta$ toward same circumferential side of the work piece 30 as FIGS. 10 and 12. Rolls 31, 32 and 33, connected to a drive source not shown, are rotated in same direction as indicated by arrow in FIG. 10, so that a hot work piece 30 threaded between the rolls are moved forward in the axial direction while being rotated on their axis. That is, the work piece 30 is diametrically reduced at a high rate while being screwed forward.

The cross-sectional configuration of hot work piece 30 is preferably circular, but it may be hexagonal or more polygonal. Since the work piece 30 is subjected to rolling while being rotated, one having a smaller number of corner may exert considerable impact on the rotary mill, being inconvenient for rolling operation. A square contour is undesirable because it will be twisted. Positioning of the step of producing material bar or billet, or of the step of elongating the material by means of the rotary mill shown in FIGS. 10 to 12, will be described hereinafter.

As earlier described, particular conditions are set on roll angles $\gamma$, $\beta$, and $\gamma+\beta$. On the upper limit side, cross angle $\gamma$ is set lower than 15°. The reason for this is that where $\gamma$ is above this limit it is likely that there will occur some interference, on the downstream side of path of the work piece, between roll ends and such portion of a roll chock as is located adjacent the pass line. On the lower limit side, $\gamma$ is set larger than 0° because a cross angle of $\gamma \leqq 0°$ will render it impossible to eliminate circumferential shear deformation at a location adjacent the center of the work piece thereof to obtain a satisfactory longitudinal dimensional accuracy.

The upper limit of feed angle $\beta$ is defined 20°. The reason for this is same as that in the case of the upper limit for $\gamma$. The lower limit of $\beta$ is $>3°$. Where $\beta$ is lower than 3°, it is impossible to minimize circumferential shear deformation at a location adjacent the center of the work piece and to produce good effect on consolidation of internal porosity in continuously cast billets (blooms).

The upper limit of $\gamma+\beta$ value is 30°. Where this limit is exceeded, there will be considerable interference between the roll chock and the rolls as above mentioned. Moreover, it will become difficult to keep bearings for the rolls as housed in the roll chock. All this will make it impracticable to maintain the both-end support arrangement for the rolls. The lower limit of $\gamma+\beta$ is 5°. Anywhere below this limit it is impossible to secure a practical rolling efficiency (velocity), and further it is difficult to consolidate porosity in the work piece from the continuous casting stage.

The $\gamma$ and $\beta$ conditions defined herein are considerably different from those according to the prior art in that the $\gamma$ values are positive. Indeed, setting of cross angle $\gamma$ on the positive side does produce a favorable effect for consolidation of internal porosity and control of circumferential shear stress. The both-end support structure for the rolls is intended to increase mill rigidity and prevent spiral mark occurrences. Such support structure is known from the article "Study on Helical Rolling" referred to above.

Various experiments have been conducted to clarify the advantages of the invention. Results of these experiments will now be explained. Pieces of material used for rolling are SAE 1045. All the pieces were heated to 1200° C. and subjected to rolling.

EXAMPLE 1

Circumferential shear strain

Figure 13:
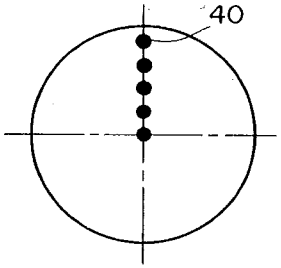
FIG. 13 is a sectional view of a test piece for circumferential shear strain measurement.

Five pins 40 (2.5 mm dia each) were embedded in each piece of mother material, 70 mm dia and 300 mm long, in axially parallel relation so that they are disposed on same radius, as FIG. 13 illustrates. After rolling, the flow of pins 40 (which represents metal flow) was checked to examine circumferential shear strain in a cross section of the material worked.

Figure 15:
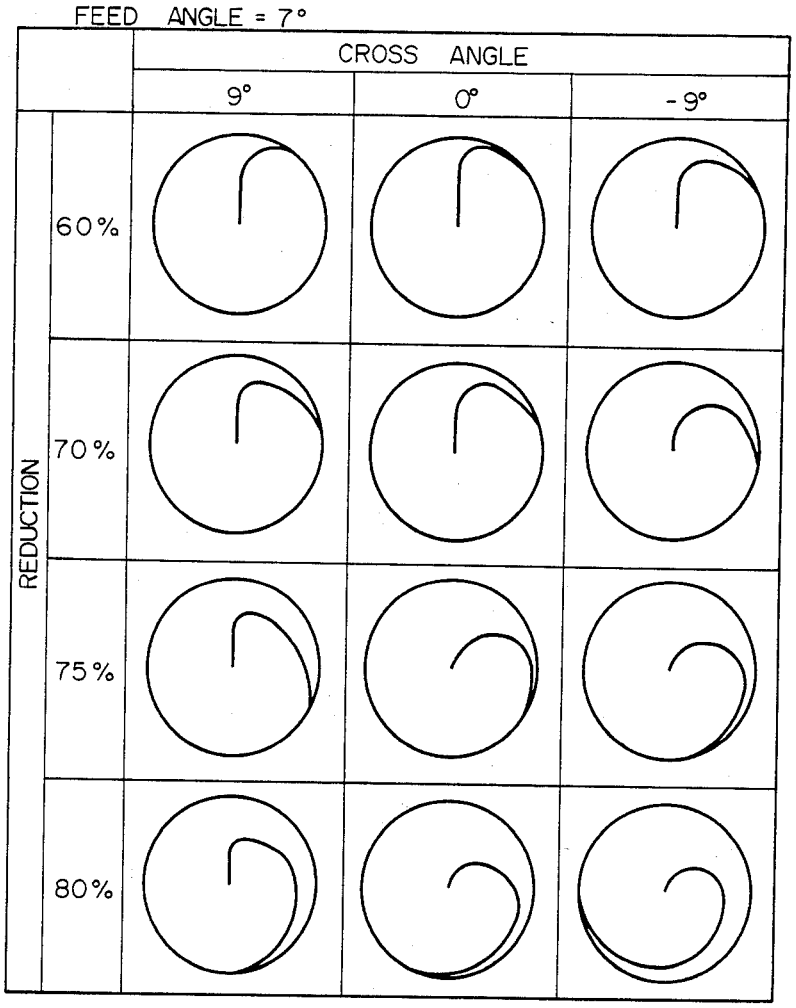
FIG. 15 is a schematic representation of circumferential shear deformation.

Rolling conditions were: feed angle $\beta$ fixed at $\beta=7°$; cross angle $\gamma$ was varied three ways, namely, 9° within the angle range defined as such herein, and 0° and −9°, both outside said range; and area reduction varied in four ways, namely, 60%, 70%, 75%, and 80%, for each cross angle $\gamma$ applied. The results of the tests are presented in FIG. 15, in which the flow of the pins connected in continuous line is shown for each case. It is apparent from the results that as the area reduction increases, circumferential shear strain becomes noticeable depending upon the cross angle applied and that where $\gamma=9°$, circumferential shear strain is smallest, though there is no much difference among the various cases, where the area reduction is small. Further, it can be seen that in the case of $\gamma=9°$ there is no circumferential shear strain at a location adjacent the cross sectional center of the work piece (that is, metal flow shows a straight configuration), whereas in the case of $\gamma=-9°$, there develops noticeable circumferential shear deformation over the entire sectional area including central portion thereof. Where $\gamma=0°$, the condition appears to be somewhere between the other two cases. Thus, the test results prove that by setting cross angle at $\gamma>0°$, or preferably by applying a larger $\gamma$ value, it is possible to prevent shear strain at a location adjacent cross sectional center of the work piece. Non-presence of circumferential shear strain means that there is present no field of circumferential shear stress. Therefore, where the method of the present invention is employed, there will be no occurrence of crack due to internal porosity; hence, no Mannesmann fracture.

EXAMPLE 2

Shrinkage behavior of artificial hole

Figure 16A:
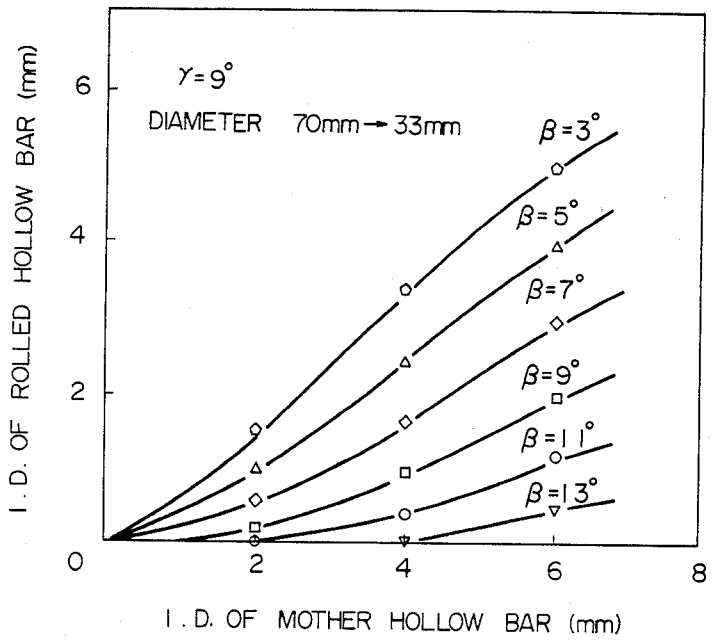
FIGS. 16 (*a*), 16 (*b*), and 16 (*c*) are graphs showing effect of feed angle and cross angle on shrinkage behavior of artificial holes.
Figure 16B:
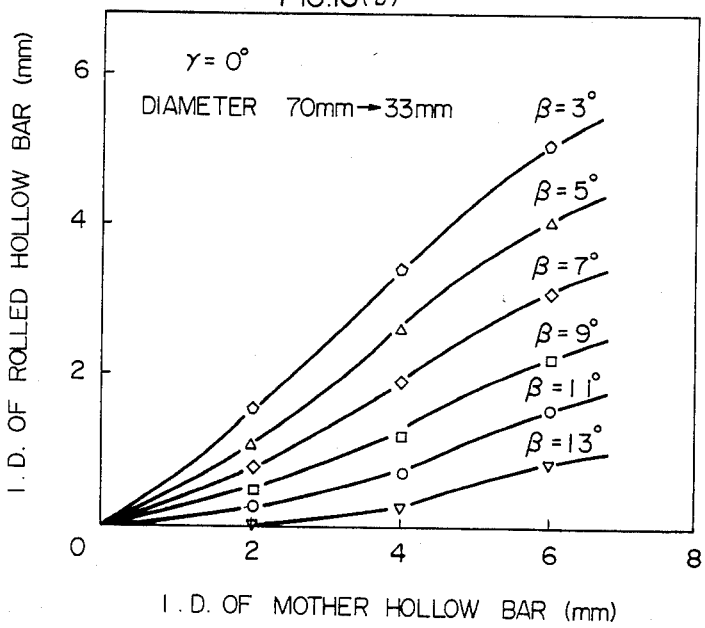
Figure 16:
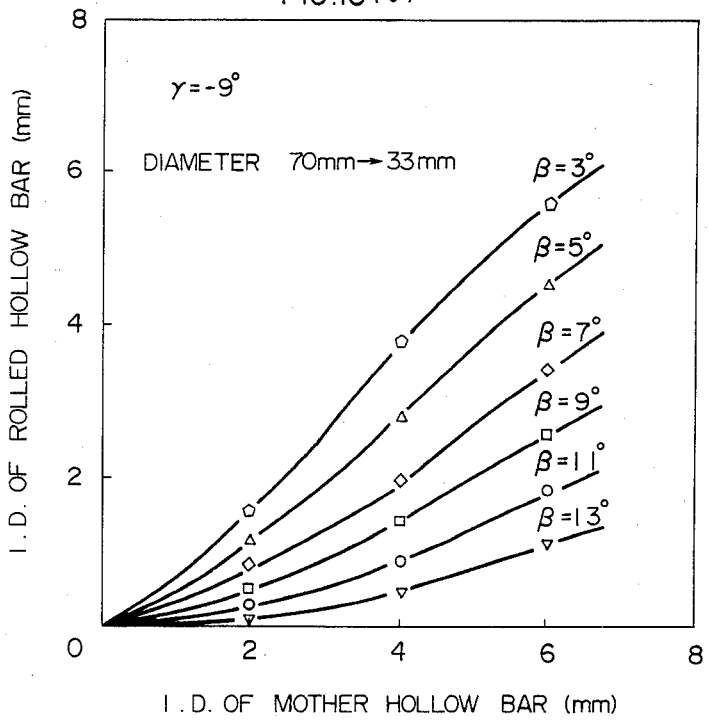

Pieces of mother material, each 70 mm dia and 300 mm long, with artificial holes bored therein (simulated for center porosity), 2 mm, 4 mm, and 6 mm dia, were used as work pieces. After the work pieces were subjected to rolling, effect on closing behavior of artificial hole by rolling was examined. For rolling operation, feed angle $\beta$ was varied in six ways within a range of 3° to 13°, and cross angle $\gamma$ was varied in three ways as is the case with Example 1, that is, $\gamma=9°$ within the range defined as such herein, and $\gamma=0°$, $-9°$, both outside said range. Diameter reduction percentage was set at 53% (reduction from 70 mm dia to 33 mm dia). Results of the tests are presented in FIGS. 16 (*a*), 16 (*b*), and 16 (*c*).

The following facts can be clearly found from the results. Where $\gamma=9°$, artificial holes of up to 4 mm dia can be shrunk, if $\beta=13°$. Where $\gamma=-9°$, however, even the smallest holes of 2 mm dia are not shrunk, even if $\beta=13°$. In the case of $\gamma=0°$, the effect obtainable is somewhere between said two cases, artificial holes of 2 mm dia being shrunk where $\beta=13°$. Whatever cross angle $\gamma$ may be, feed angle $\beta$ has an effect on the shrinkage behavior of artificial holes, and the larger the feed angle $\beta$, the greater is its effect on shrinkage behavior.

Thus, it may be said that where $\gamma>0°$ and if cross and feed angles are set larger, greater consolidation effect is obtainable with respect to internal porosity.

EXAMPLE 3

Characteristics of consolidation of internal porosity in continuously cast billet Effect on consolidation of internal porosity was examined by using pieces of mother material as produced by continuous casting.

Figure 17:
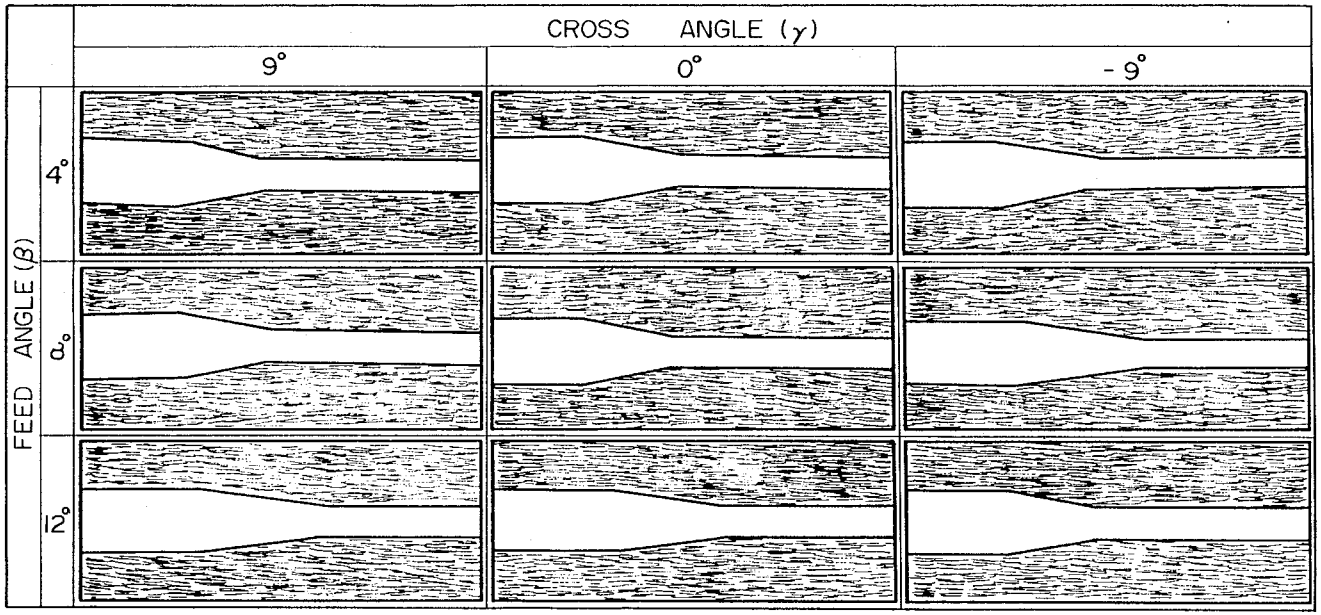
FIG. 17 is a photographic representation showing effect of feed angle and cross angle on shrinkage of internal porosity in round continuously cast billets.

Work pieces used, each was a round bar cut, 70 mm dia and 300 mm long, from a central portion of a continuously cast large-section billet which is 380 mm dia. The work piece was rolled for 78% area reduction (from 70 mm dia to 33 mm dia). Rolling conditions were: feed angle $\beta$ varied three ways, 4°, 8°, and 12°, and cross angle $\gamma$ three ways, 9°, 0°, and =9°, that is, 9 ways altogether. In the course of rolling operation the rotary mill was stopped to provide semi-rolled pieces. These pieces were longitudinally cut in half and the so cut pieces were examined as to the condition of internal porosity. The results of the examination are photographically shown in FIG. 17. They have revealed the following points:

(i) Where cross angle $\gamma=-9°$, defects, initiated by porosity in the mother material, develop under the influence of circumferential shear stress. That is, there occurs a phenomenon of so-called Mannesmann fracture. The larger the feed angle $\beta$, the less is the degree of such fracture. However, it is difficult to obtain a sound internal configuration.

(ii) Where cross angle $\gamma=9°$, porosity is completely consolidated (vanished), even if feed angle $\beta$ is set low.

(iii) When cross angle $\gamma=0°$, condition is somewhere between above two cases. If feed angle $\beta$ is larger, consolidation of internal porosity is favorable.

Hence, where continuously cast billets are subjected to rolling, it is desirable to use cross angle $\gamma>0°$, preferably a larger cross angle, and relatively large feed angle from the standpoint of consolidation of internal porosity.

EXAMPLE 4

Shear strain due to surface twist

Shear strain due to surface twist is the only factor with respect to which the present invention is unfavorably compared with the two known techniques referred to hereinabove.

Figure 3:
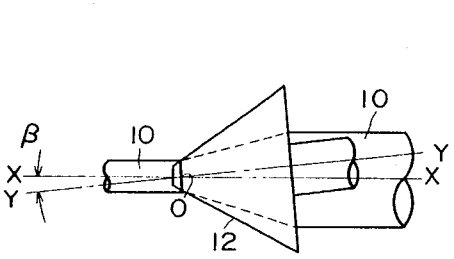
FIG. 3 is a side view showing a feed angle $\beta$ therein.
Figure 2:
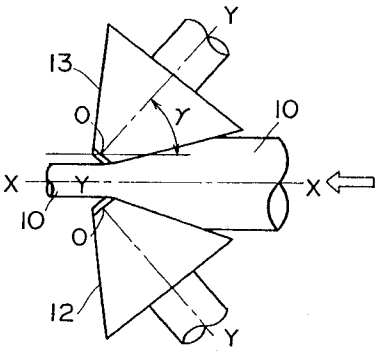
FIG. 2 is a section taken on the line II—II in FIG. 1.
Figure 1:
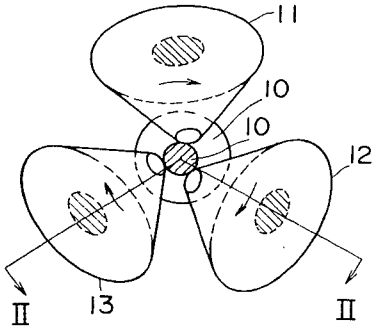
FIG. 1 is a front view schematically showing the construction of a conventional inclined-roll type rotary mill.
Figures 4, 5, 6:
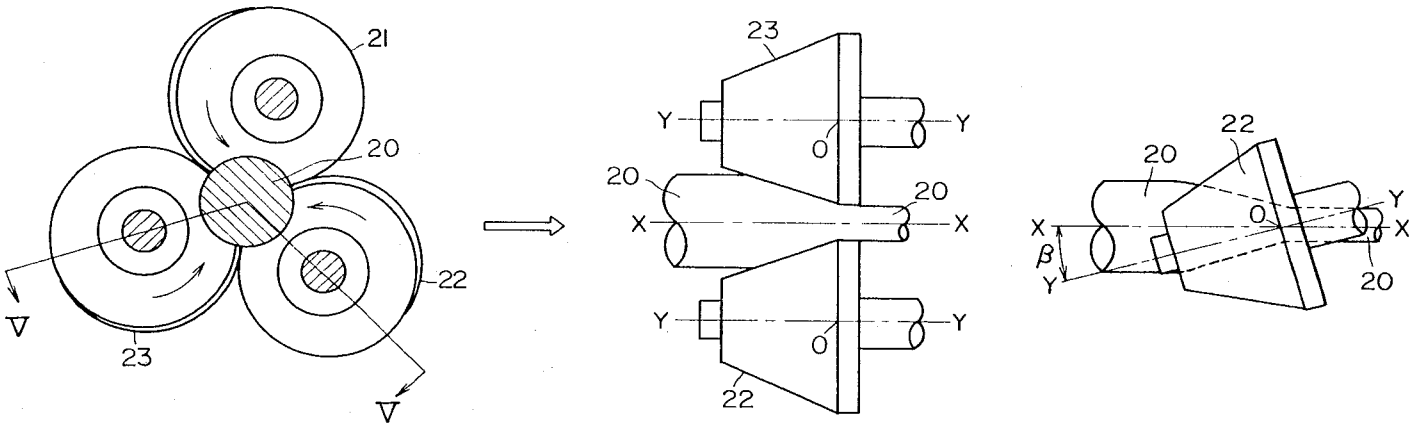
FIG. 4 is a front view schematically illustrating a conventional method for helical rolling of a round steel stock.
FIG. 5 is a section taken on the line V—V in FIG. 4.
FIG. 6 is a side view showing a feed angle $\beta$ therein.
Figure 9:
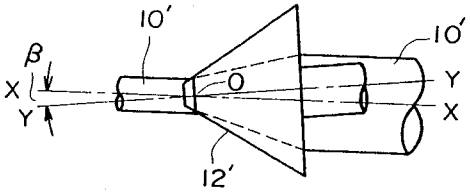
FIG. 9 is a side view taken along the line IX—IX in FIG. 7.
Figure 8:
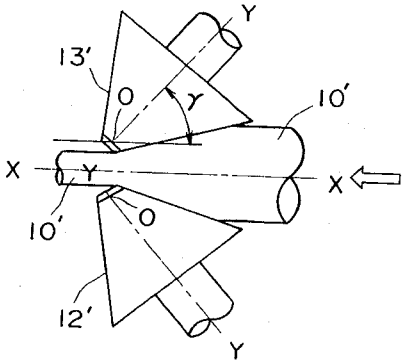
FIG. 8 is a section taken along the line VIII—VIII in FIG. 7.
Figure 7:
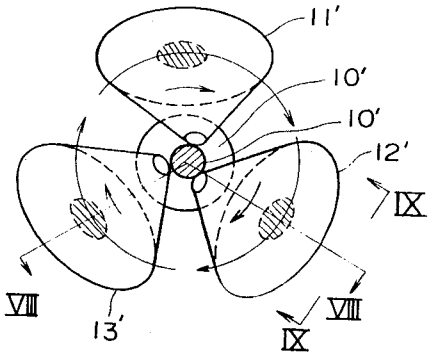
FIG. 7 is a front view showing the roll arrangement in another conventional type rotary mill.
Figure 19:
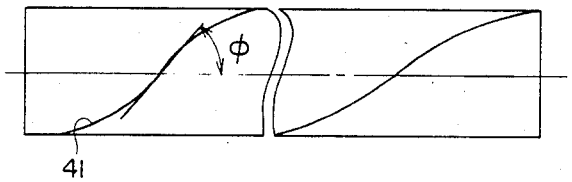
FIG. 19 is a side view showing post-rolling groove configuration therein.
Figure 20:
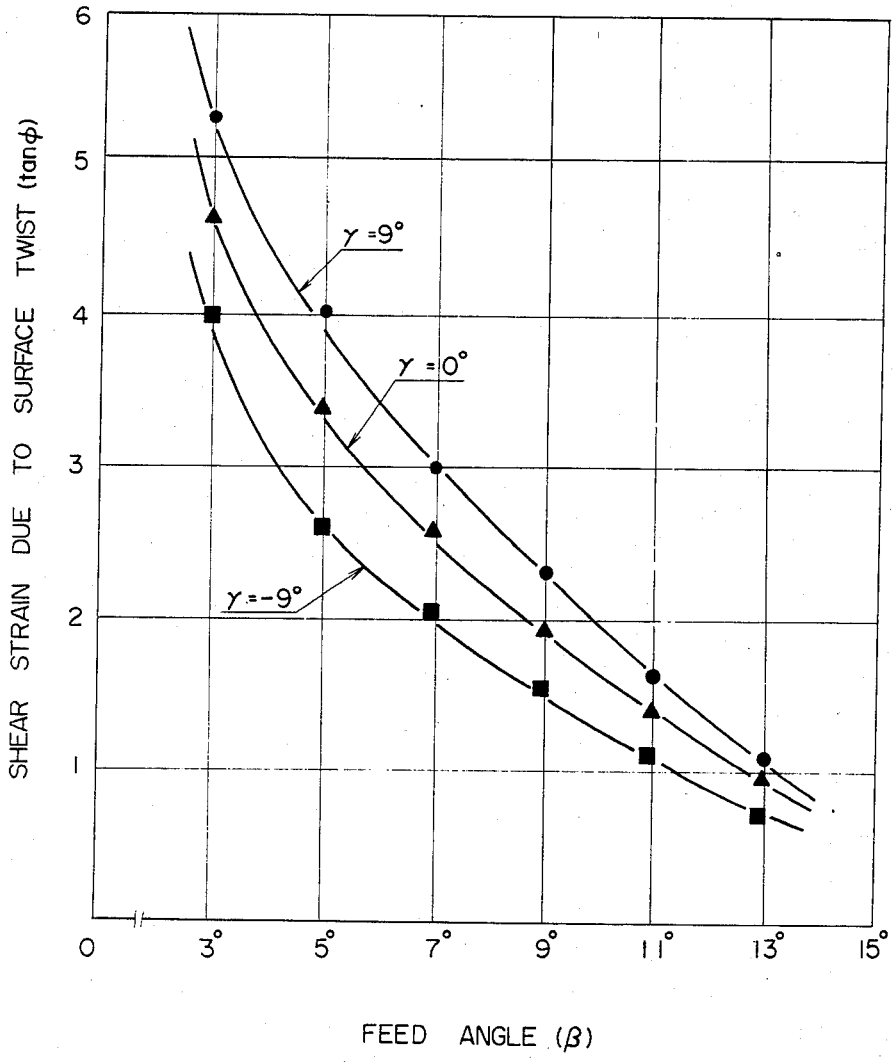
FIG. 20 is a graphical representation showing shear strain due to surface twist.

Work pieces were prepared by longitudinally forming a groove 41, 1 mm deep and 1 mm wide, on the surface of the mother material, as FIGS. 8 (*a*) and 18 (*b*) show. Each work piece was rolled for area reduction of 78% (from 70 mm dia to 33 mm dia). Angle-of-twist measurements with respect to the groove 41 after rolling are shown in FIG. 20. (The term "angle of twist" refers to an angle between a straight line on the surface parallel to the axis and the trace of the groove 41, as shown in FIG. 19). Rolling conditions were: feed angle $\beta$ varied six ways within the range of 3° to 13°, and cross angle $\gamma$ varied three ways, 9°, 0°, and $-9°$, that is, eighteen ways altogether. As a result, the following points have been revealed.

(i) Where $\gamma=-9°$, shear strain due to surface twist is insignificant.

(ii) Where $\gamma=9°$, shear strain due to surface twist is substantial. However, this defect can be reduced by using a larger feed angle.

(iii) where $\gamma=0°$, condition is somewhere between above two cases.

Thus, it may be said that when applying the method of the present invention, it is desirable to set feed angle $\beta$ relatively large from the standpoint of reducing shear strain due to surface twist.

EXAMPLE 5

Longitudinal dimensional accuracy

Figure 21:
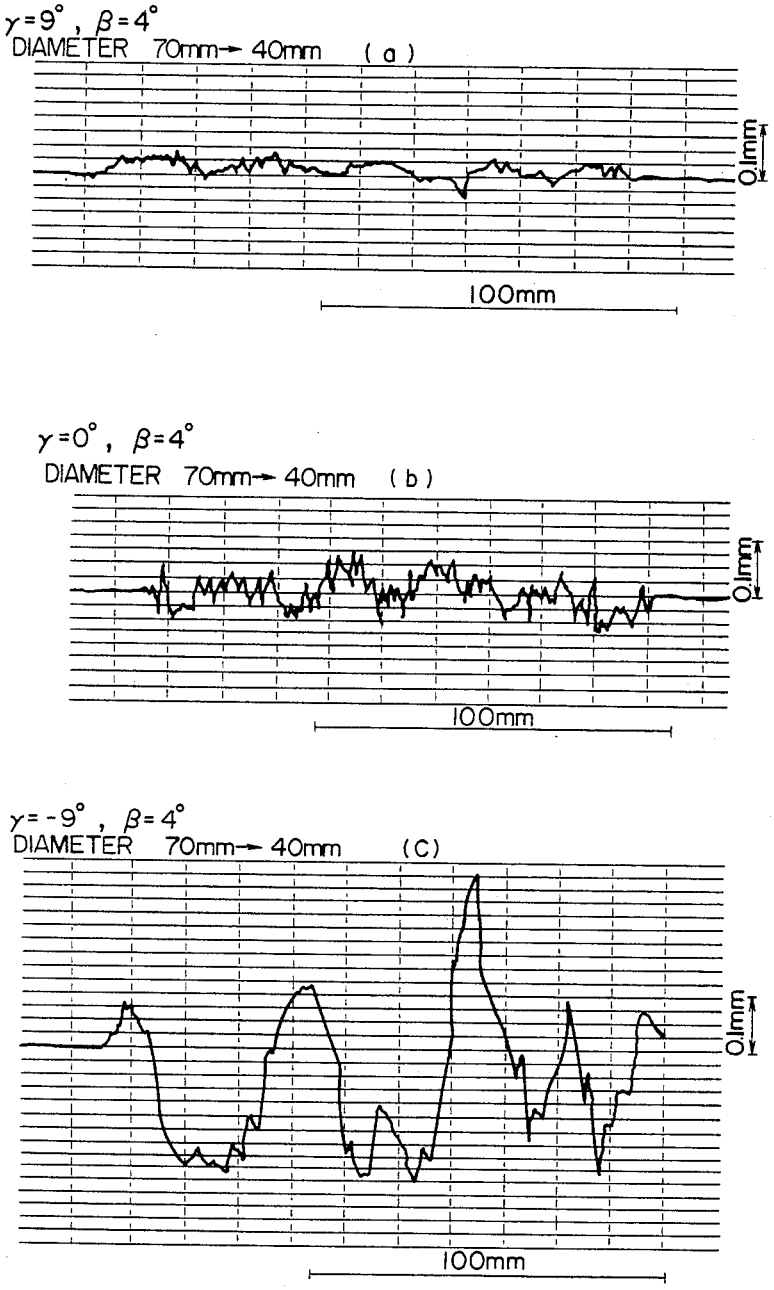
FIGS. 21 (*a*), 21 (*b*), and 21 (*c*) are graphic charts showing longitudinal dimensional accuracy measurements.

Pieces of mother material, each 70 mm dia and 300 mm long, were rolled for area reduction of 67% (from 70 mm dia to 40 mm dia). Longitudinal dimensional changes were examined. Rolling conditions were: feed angle $\beta=4°$, and cross angle varied three ways, 9°, 0°, and $-9°$. The results are shown in FIGS. 21 (*a*), 21 (*b*), and 21 (*c*). Where $\gamma=9°$, the degree of change was $\pm0.10\%$, and where $\gamma=-9°$, it was $\pm0.75\%$. Where $\gamma=0°$, change was somewhere between above two cases. It is apparent that cross angle $\gamma<0°$ is effective for dimensional accuracy purposes.

EXAMPLE 6

Rolling velocity

Figure 22:
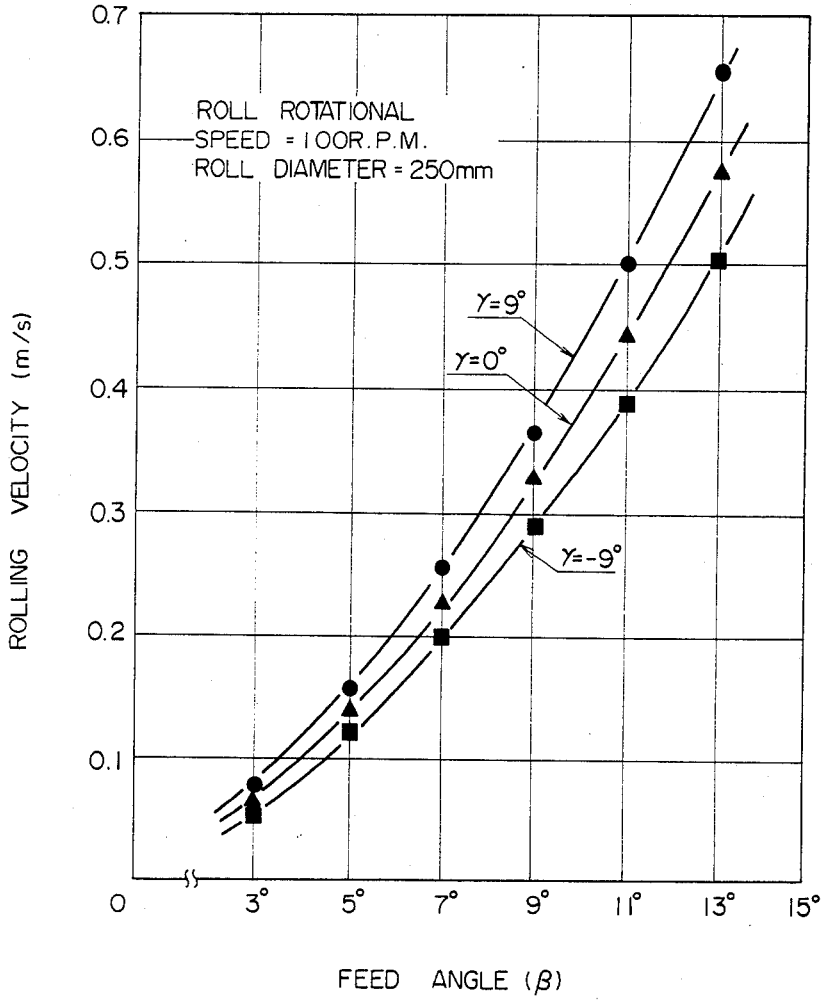
FIG. 22 is a graph showing rolling velocity measurments.

Rolling velocities in the case of 70 mm dia mother material being rolled for area reduction of 78% (from 70 mm dia to 3$\beta$ mm dia) were examined. Rolling conditions: roll rotational speed 100 r.p.m.; roll gorge diameter 250 mm; feed angle $\beta$ varied six ways, 3° to 13°, feed angle $\beta$ three ways, 9°, 0°, and −9°, total 18 angle variations. The results are shown in FIG. 22. Where $\gamma=9°$, higher rolling velocity are available. Rolling velocity tends to become higher as feed angle $\beta$ becomes greater. Therefore, in order to increase rolling efficiency, it is desirable to set cross angle $\gamma>0°$, and preferably larger, with feed angle $\beta$ set reasonably large.

EXAMPLE 7

Examples of application for rolling of hard-to-work materials

High-Ni and high-Cr alloy steels as shown in the following table were examined as to their workability at the elongating stage covered by the present invention. Each piece of material was heated to a specific temperature at which its deformability is low, and then subjected to rolling. High-reduction rolling was found possible, with reduction per pass of 40 to 80%. Where reduction is more than 80%, the temperature of the work piece becomes excessively high to the extent the deformability of the work piece is lost in the course of rolling until it is reduced to pieces.

| Sample No. | Ni | Cr | Mo | Heating temp |
|---|---|---|---|---|
| 1 | 49.2 | 24.4 | 5.8 | 1210° C. |
| 2 | 6.84 | 25.8 | 3.0 | 1240 |
| 3 | 9.20 | 18.1 | 0.16 | 1200 |
| 4 | 11.7 | 17.0 | 2.3 | 1200 |
| 5 | 36.5 | 26.4 | 3.2 | 1210 |
| 6 | 40.5 | 30.5 | 3.2 | 1210 |

The elongating stage described above may be employed in various steel product manufacturing processes in the following way:

One way of application is that the elongating stage is employed as a blooming stage is steel product manufacturing. That is, billets as cast by a continuous casting machine are supplied to the elongating stage, and materials rolled thereat may be subsequently supplied to a tube mill, merchant bar mill, wire rod mill, or shaped steel mill according to type of the product.

It is also possible that materials as cast from ingots are supplied as work pieces to the elongating stage, or that ingots are passed through a bloom rolling mill into billets, which in turn are supplied to said elongating stage.

Another mode of application is that the elongating stage according to the invention is employed as a rough rolling stage for material supply to a merchant bar mill or wire rod mill. That is, billets as cast by a continuous casting machine are supplied to the elongating stage for rough rolling, and materials rough-rolled thereat are then supplied to an intermediate or finish rough rolling mill for manufacturing bar steels or wire rods. It is also possible that blooms as cast by a continuous casting machine, that the blooms are subjected to blooming and thereafter supplied to said elongating stage for rough rolling thereat, the materials so rough-rolled being then supplied to an intermediate or finish rolling mill for bar or wire rod manufacturing. Furthermore, it is possible that billets obtained by blooming ingots are supplied to said elongating stage for rough rolling, the product being then supplied to an intermediate or finish rolling mill for bar or wire rod manufacturing.

A further mode of application is that the elongating stage is employed as a merchant bar mill stage. That is, billets as produced by a continuous casting machine are supplied to said elongating stage for rolling into bars. Or, blooms cast by a continuous casting machine are bloomed into billets, and the so-produced billets are supplied to said stage for manufacture into bars. It is also possible to supply billets, produced by blooming ingots, to said stage for bar manufacturing.

Figure 24:
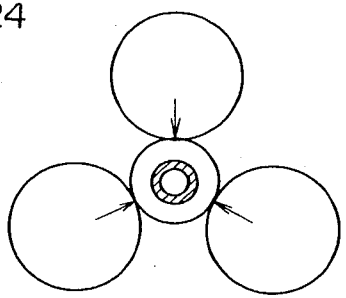
FIGS. 23 and 24 are explanatory views showing Mannesmann fracture.
Figure 23:
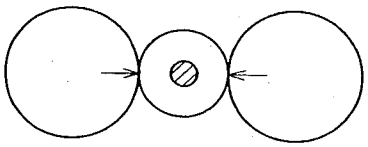

Next, reasons why so-called Mannesmann fracture can be reduced by employing a three- or four-roll rotary mill are explained. If, as FIGS. 23 and 24 shown, forces of rolls are exerted on a solid circular-section material in two or three directions, a tensile stress called "secondary tension" develop in the central portion of the material in the case where two rolls are used, or in radially central portion where three rolls are used, as generally shown by oblique lines in the figure. Said secondary tension induces a Mannesmann fracture. Therefore, where two rolls are used, such fracture develops in the central portion. Now, where three rolls are used, and if cross and feed angles $\gamma$ and $\beta$ are selected in manner as described hereinabove, no secondary tension will develop, whereby any Mannesmann fracture may be prevented. It is noted that area liable to Mannessmann fracture is smaller in the case where four rolls are used than where three rolls are present, the fracture preventing effects proved with three rolls equally apply where four rolls are used. However, use of five or more rolls is not realistic from the standpoint of roll layout, and therefore, the number of rolls is limited to three or four Next, another version of the method of the invention, in which the work piece or material being worked is not rotated, will be explained in detail.

Figure 27:
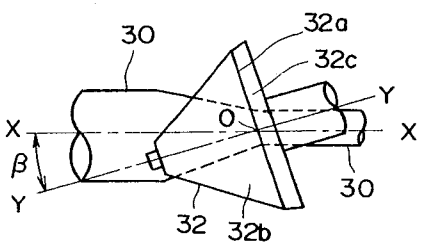
FIG. 27 is a section taken on the line XXVII—XXVII in FIG. 25.
Figure 26:
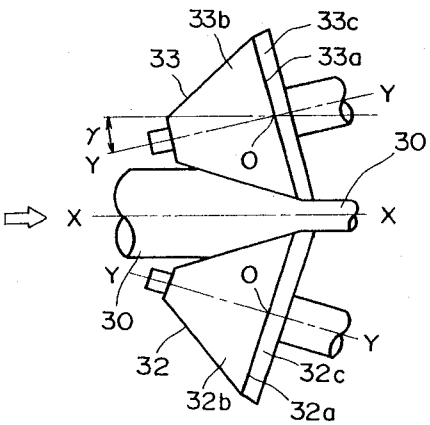
FIG. 26 is a section taken along the line XXVI—XXVI in FIG. 25.
Figure 25:
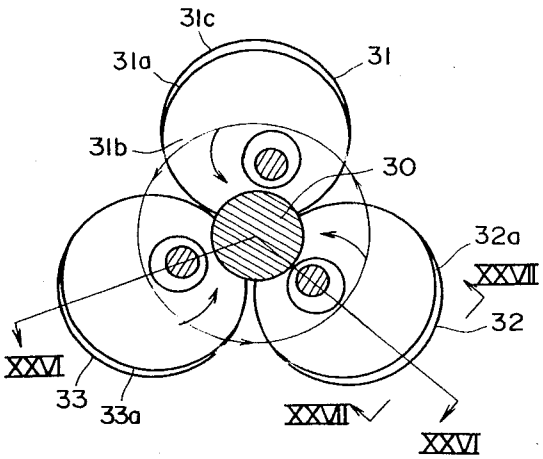
FIG. 25 is a front view schematically showing the construction of a rotary mill employed in practicing the method of the invention.

FIG. 25 is a schematic view in front elevation showing the roll arrangement in a rotary mill employed in practicing the method. FIG. 26 is a sectional view taken along the line XXVI—XXVI in FIG. 25. FIG. 27 is a side view taken along the line XXVII—XXVII in FIG. 25. In the figures, numeral 30 designates work piece, and 31, 32 and 33 designate rolls. The work piece 30, produced by a continuous casting machine, for example, is supplied to the rotary mill at same speed as casting in the direction of the larger arrow. The rolls 31, 32 and 33 of the rotary mill have gorges 31*a*, 32*a* and 33*a* respectively adjacent their ends on the work piece outlet side. With the gorge as a border, each roll has its diameter reduced straightforwardly toward its shaft end on the work piece inlet side and has its diameter enlarged in a straight-line or curved-line pattern on the work piece outlet side. Therefore, the rolls 31, 32 and 33 are of substantially truncated cone shape and have inlet surfaces 31*b*, 32*b* and 33*b* and outlet surfaces 31*c*, 32*c* and 33*c*. The rolls 31, 32 and 33 are arranged in such a way that their inlet surfaces 31*b*, 32*b* and 33*b* are disposed on the upstream side of the path of the work piece 30 and that intersecting points O between the roll axes Y—Y and a plane including the gorges 31*a*, 32*a* and 33*a* (said intersecting points O to be hereinafter referred to as roll setting centers) are positioned in substantially equal spaced relation around the pass line X—X and on a plane intersecting orthogonally with the pass line X—X. Axes Y—Y of the rolls 31, 32, and 33 are crossed (inclined) at a cross angle $\gamma$ at their respective roll setting centers O relative to the pass line X—X so that their front shaft ends stay close to the pass line X—X as FIG. 26 shows, and at same time their front shaft ends are inclined at a feed angle $\beta$ toward same circumferential side of the work piece 30 as FIGS. 25 and 27. The rolls are supported at their respective both shaft ends in a housing (not shown) adapted to be rotated around the work piece 30. The housing and the rolls 31, 32 and 33 are connected to relevant drive sources not shown. While being driven to rotate on their axes in the direction of arrow in FIG. 25, the rolls 31, 32 and 33 are caused to rotate by the housing around the work piece 30 in the direction of arrow as shown to roll the work piece 30.

In the above description, the rolls are supported at their respective both shaft ends in the housing, but needless to say, they may be one-end supported in such a way that their respective shaft ends on the work piece outlet end are supported in the housing.

The cross-sectional configuration of hot work piece 30 is preferably circular, but it may be hexagonal or more polygonal. Since the rolling is performed by rotating the roll housing, one having a smaller number of angles may exert considerable impact on the rotary mill, being inconvenient for rolling operation. A square contour is undesirable because it will be twisted.

Said cross and feed angles are set so that the following conditions are met:

$$0° < \gamma < 60° \quad (1)$$

$$3° < \beta < 45° \quad (2)$$

The upper limit of cross angle should be $\gamma < 60°$, because where $\gamma$ is above this limit the rolls will interfere with one another, so that the target product diameter may not be achieved. On the lower limit side, should be higher than 0° because a cross angle of $\gamma \leqq 0$ will render it impossible to eliminate circumferential shear deformation at a location adjacent the center of the work piece thereof to obtain a satisfactory longitudinal dimensional accuracy.

The upper limit of feed angle $\beta$ should be $\beta < 45°$, because if it is larger, the shaft support structure required to ensure sufficient mill rigidity would be exceedingly large, which would make it impracticable to obtain sufficient rolling velocity where rolling is to be effected while the mill being rotated. The lower limit of $\beta$ should be $> 3°$. If $\beta$ is 3° or lower than 3°, it is impossible to minimize circumferential shear deformation at a location adjacent the center of the work piece and to produce good effect on consolidation of internal porosity in continuously cast billets (blooms).

The $\gamma$ and $\beta$ conditions defined herein are considerably different from those according to the prior art in that $\gamma$ values are positive and that $\beta$ values are larger. This is a factor contributing significantly toward improved consolidation with respect to porosity and control of circumferential shear stress.

Next, results of various experiments conducted to clarify the advantages of the method of the invention will be explained. Pieces of material used for rolling are SAE 1045 carbon steel. All the pieces were heated to 1200° C. For rolling operation, housing rotational speed was set at 150 r.p.m. and that of the rolls at 50 r.p.m.

EXAMPLE 8

Circumferential shear strain

Five pins 40 (2.5 mm dia each) were embedded in each piece of mother material, 70 mm dia and 300 mm long, in axially parallel relation so that they are disposed on same radius, as illustrated in FIG. 13. After rolling, the flow of pins 40 (which represents metal flow) was checked to examine circumferential shear strain in a cross section of the material worked.

Figure 28:
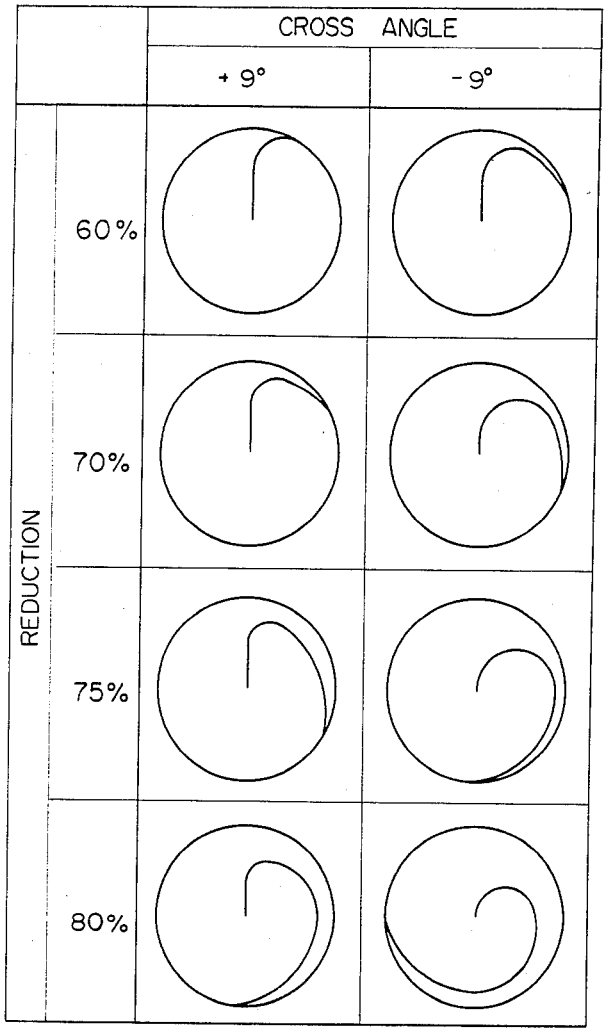
FIG. 28 is a schematic representation showing circumferential shear deformation.

Rolling conditions were set as follows: feed angle $\beta$ was fixed at $\beta = 7°$; cross angle $\gamma$ was varied in two ways, namely, 9° within the angle range defined as such herein and −9° outside said range; and area reduction was varied in four ways, namely, 60%, 70%, 75%, and 80% for each cross angle $\gamma$ applied. The results of the tests are presented in FIG. 28, in which the flow of the pins connected in continuous line is shown for each case. It is apparent from the results that as the area reduction increases, circumferential shear strain becomes noticeable depending upon the cross angle applied and that where $\gamma = 9°$, circumferential strain is smallest, though there is no much difference among the various cases, if the area reduction is small. Further, it can be seen that in the case of $\gamma = 9°$ there is no circumferential shear strain at a location adjacent cross sectional center of the work piece (that is, metal flow shows a straight configuration), whereas in the case of $\gamma = 9°$, there develops noticeable circumferential shear deformation over the entire sectional area including central portion thereof. In other words, by setting cross angle at $\gamma > 0°$, and preferably by applying a larger $\gamma$ value, it is possible to prevent shear strain at a location adjacent cross sectional center of the work piece. Nonpresence of circumferential shear strain means that there is present no field of circumferential shear stress. Therefore, where the method of the invention is employed, there will be no occurrence of crack due to internal porosity; hence, no Mannesmann fracture.

EXAMPLE 9

Shrinkage behavior of artificial hole

Figure 29A:
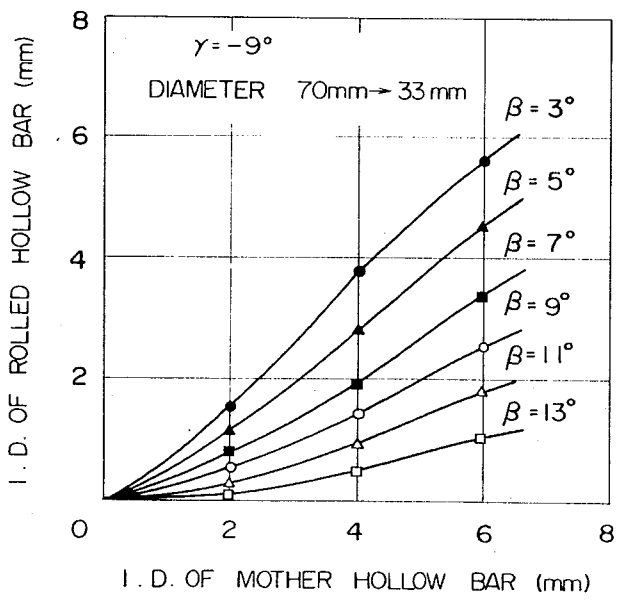
FIGS. 29 (*a*) and 29 (*b*) are graphs showing effect of feed angle and cross angle on shrinkage behavior of artificial holes.
Figure 29B:
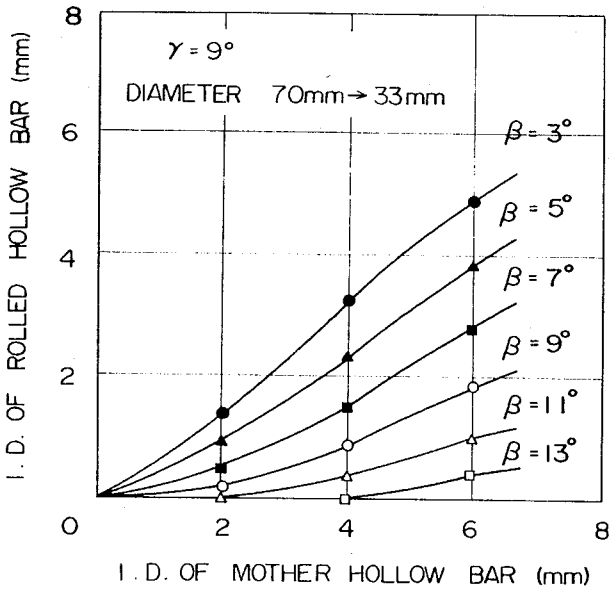

Pieces of mother material, each 70 mm dia and 300 mm long, with artificial holes bored therein (simulated for center porosity), 2 mm, 4 mm, and 6 mm dia, were used as work pieces. After the work pieces were subjected to rolling, effect on shrinkage behavior of artificial hole by rolling was examined. Feed angle was varied in six ways within a range of 3° to 13°, and cross angle $\gamma$ was varied in two ways, that is, $\gamma = 9°$ within the range defined as such herein, and $\gamma = -9°$ which is outside said range, as is the case with Example 8. O.D. reduction was set at 53% (reduction from 70 mm dia to 33 mm dia). Results of the tests are presented in FIGS. 29 (*a*) and 29 (*b*).

The following facts can be clearly found from the results. Where $\gamma = 9°$, artificial holes of up to 4 mm dia can be shrunk, if $\beta = 13°$. Where $\gamma = -9°$, however, even the smallest holes of 2 mm dia are not shrunk, even if $\beta = 13°$. Whatever cross angle $\gamma$ may be, feed angle $\beta$ has an effect on the shrinkage behavior of artificial holes, and the larger the feed angle $\beta$, the greater is its effect on shrinkage behavior.

Thus, it may be said that where $\gamma > 0°$, and if cross and feed angles are set larger, greater consolidation effect is obtainable with respect to internal porosity.

EXAMPLE 10

Characteristics of consolidation of internal porosity in continuously cast billet Effect on consolidation of internal porosity was examined by using pieces of mother material as product by continuous casting machine.

Figure 30:
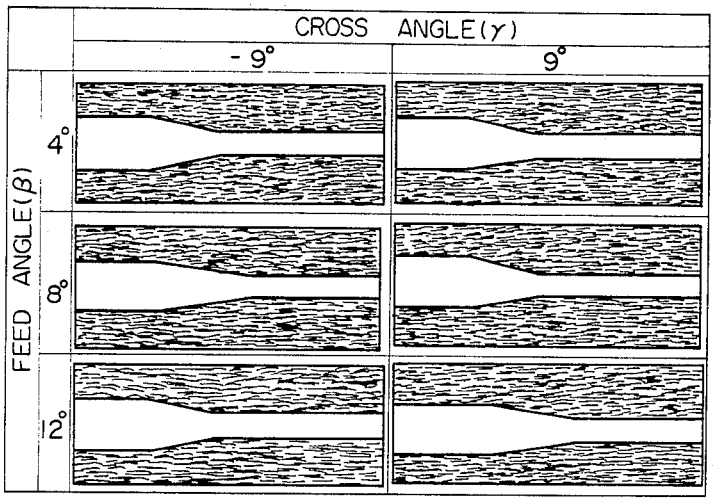
FIG. 30 is a photographic representation showing effect of feed angle and cross angle on consolidation of internal porosity in round continuously cast billets.

Work pieces used, each was a round bar cut, 70 mm dia and 300 mm long, from a central portion of a continuously cast large-section billet which is 380 mm dia. The work piece was rolled for 78% area reduction (from 70 mm dia to 33 mm dia). Rolling conditions were: feed angle $\beta$ varied three ways, 4°, 8°, 12°, and cross angle $\gamma$ two ways, 9° and −9°, that is six ways altogether. In the course of rolling operation the rotary mill was stopped to provide semi-rolled pieces. These pieces were longitudinally in half and so cut pieces were examined as to the condition of internal porosity. The results of the examination are photographically presented in FIG. 30. The following points have been revealed:

(i) Where cross angle $\gamma=-9°$, defects, initiated by porosity in the mother material, develop under the influence of circumferential shear stress. That is, there occurs a phenomenon of so-called Mannesmann fracture. The larger the feed angle $\beta$, the less is the degree of such fracture. However, it is difficult to obtain a sound internal configuration.

(ii) Where cross angle $\gamma=9°$, porosity is completely consolidated (vanished), even if feed angle $\beta$ is set low.

Hence, where continuously cast billets are subjected to rolling, it is desirable to use cross angle $\gamma>0°$, preferably a larger cross angle, and relatively large feed angle from the standpoint of consolidation of internal porosity.

EXAMPLE 11

Shear strain due to surface twist

Figure 18A:
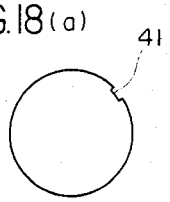
FIGS. 18 (*a*) and 18 (*b*) are front and side views showing test pieces for measurement of shear strain due to surface twist.
Figure 18B:
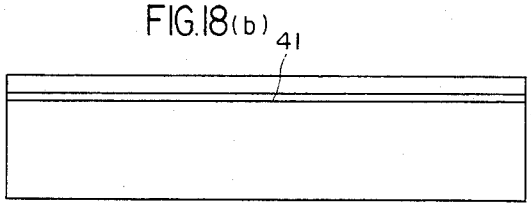
Figure 31:
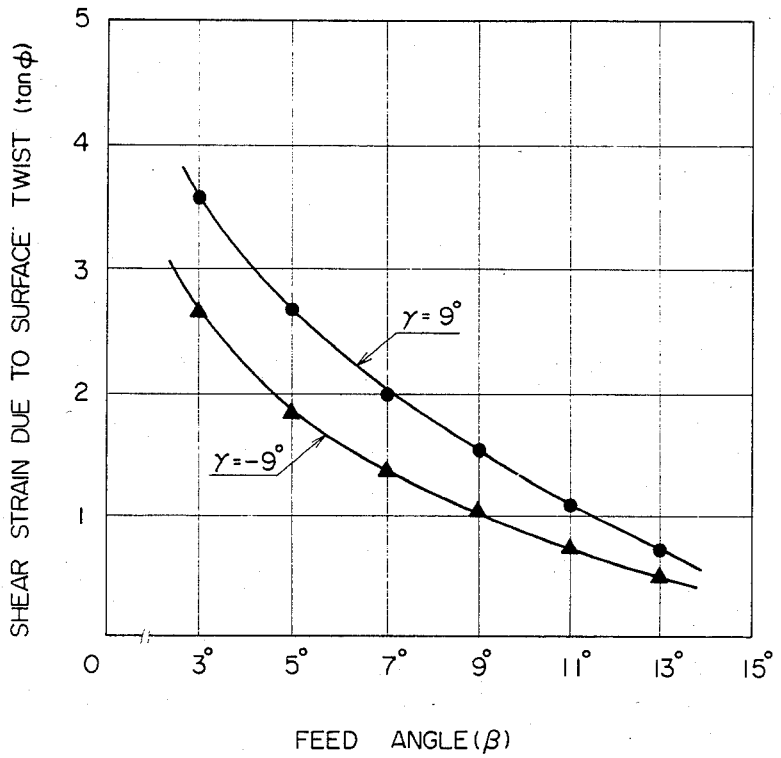
FIG. 31 is a graph showing shear strain due to surface twist.

Shear strain due to surface twist is the only factor with respect to which the present invention is unfavorably compared with the two known techniques referred to hereinabove. Work pieces were prepared by longitudinally forming a groove 41 1 mm deep and 1 mm wide, on the surface of the mother material, as FIGS. 18 (*a*) and 18 (*b*) show. Each work piece was rolled for area reduction of 78% (from 70 mm dia to 33 mm dia). Angle of twist measurements with respect to the groove 41 after rolling are shown in FIG. 31. (The term "angle of twist" refers to an angle between a straight line on the surface parallel to the axis and trace of the groove 41, as shown in FIG. 19). Rolling conditions were: feed angle $\beta$ varied six ways within the range of 3° to 13°, and cross angle $\gamma$ varied two ways, 9° and −9°, that is, eighteen ways altogether. The following points are apparent from the measurements.

(i) Where $\gamma=-9°$, shear strain due to surface twist is insignificant.

(ii) Where $\gamma=9°$, shear strain due to surface twist is substantial. However, this defect can be reduced by using a larger feed angle $\beta$.

Thus, it may be said that when applying the method of the present invention, it is desirable to set feed angle $\beta$ relatively large from the standpoint of reducing shear strain due to surface twist.

EXAMPLE 12

Longitudinal dimensional accuracy

Figure 32:
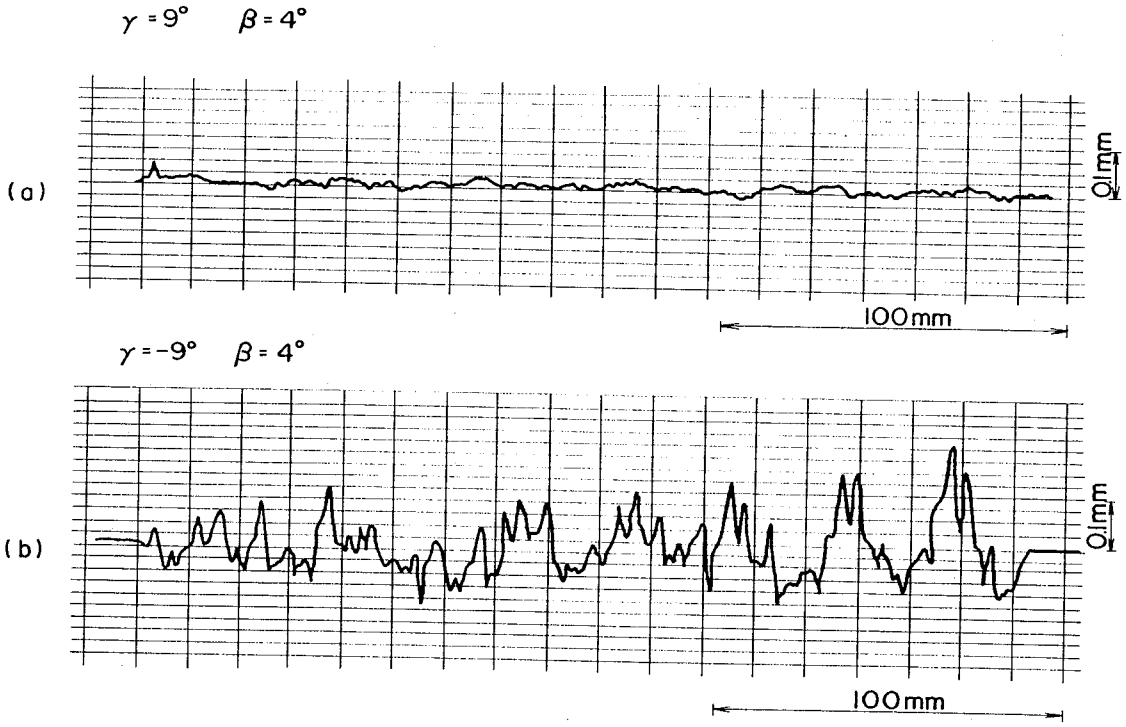
FIG. 32 is a graphic chart showing longitudinal dimensional accuracy measurements.

Pieces of mother material, each 70 mm dia and 300 mm long, were rolled for area reduction of 67% (from 70 mm dia to 40 mm dia). Longitudinal dimensional changes were examined. Rolling conditions were: feed angle $\beta=4°$, and cross angle varied two ways, 9° and −9°. The results are shown in FIGS. 32 (*a*) and 32 (*b*). Where $\gamma=9°$, the degree of change was ±0.05%, and where $\gamma=-9°$, it was ±0.4%. It is apparent that cross angle $\gamma>0°$ is effective for dimensional accuracy purposes.

EXAMPLE 13

Rolling velocity

Rolling velocities in the case of 70 mm dia mother material being rolled for area reduction of 67% (from 70 mm dia to 33 mm dia) were examined.

Figure 33:
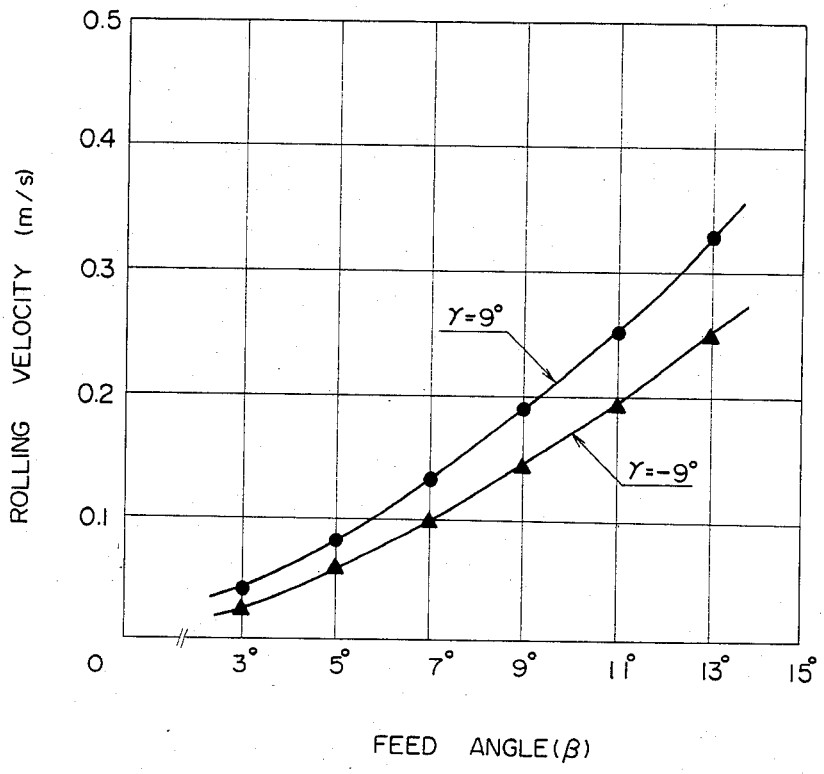
FIG. 33 is a graph showing rolling velocity measurements.

Rolling conditions: roll rotational speed was 100 r.p.m.; roll gorge diameter was 250 mm. Feed angle were varied six ways, 3° 13°, and cross angle $\gamma$ was varied two ways, 9° and −9°, total 18 angle variations. The results are shown in FIG. 33. Where $\gamma=9°$, higher rolling velocity is available. Rolling velocity tends to become higher as feed angle $\beta$ becomes larger. Therefore, it is desirable to set cross angle $\gamma>0°$, and preferably larger, with feed angle $\beta$ set reasonably larger.

EXAMPLE 14

Ratio of housing rotational speed and roll rotational speed

The relationship between housing rotational speed $N_H$ (r.p.m.) and roll rotational speed $N_R$ (r.p.m.), that is, ratio $N_H/N_R$, was examined for rolling operation with 70 mm dia material. Rolling conditions were: elongation in five ways between 2 and 10, and $N_H/N_R$ in six ways, 1.5 to 6.5, that is, 30 ways in total. The results are shown in the following table, wherein "+" sign represents the direction of work piece rotation opposite from that of roll rotation, and "−" sign represents work piece rotation in the direction of roll rotation.

| | Elongation | | | | |
|---|---|---|---|---|---|
| $N_H/N_R$ | 2 | 4 | 6 | 8 | 10 |
| 1.5 | + | + | + | + | + |
| 2.0 | + | + | + | + | − |
| 3.3 | + | + | + | − | − |
| 4.7 | + | + | + | − | − |
| 6.0 | + | − | − | − | − |
| 6.5 | − | − | − | − | − |

As is apparent from above table, where $N_H/N_R$ is within the range stated by the following relation, values at which the work piece does not rotate may be selectively set according to the elongation (within the range of 2 to 10).

$$2<N_H/N_R<6 \quad (3)$$

As above described, it is possible to manufacture high-quality metallic materials having a circular cross section by employing the method in which the work piece is not rotated. In various steel product manufacturing processes, the step of rolling and elongating herein described can be employed in the following way.

One way of application is that billets as cast by a continuous casting machine are supplied directly to the elongating stage without cutting. Said elongating stage may be employed as blooming stage so that materials rolled thereat are supplied to a tube mill, merchant bar mill, wire rod mill, or sections making mill. The elongating stage may also be employed as rough rolling stage so that materials rolled thereat are supplied to an intermediate or finish merchant bar mill or wire rod mill. It is also possible to employ the elongating stage as a finish rolling stage for manufacturing bar steels.

Another way of application is that materials as rolled by a bloom rolling mill are supplied to the elongating stage herein described for blooming thereat and for subsequently supplying work materials to various rolling mills.

A further way of application is that materials as rolled by a blooming mill are supplied, without cutting, to said elongating stage for manufacture of a finished product or an intermediate product for supply to an intermediate or finish rolling mill.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A method of manufacturing metallic bar or rod having a circular cross-section which comprises the steps of producing a solid bar-form material having a cross-section which is circular or a polygon of six or more sides and thereafter elongating the said material into a circular cross-sectional bar or rod of reduced diameter by working said material in a rotary mill, said rotary mill comprising three or four rolls arranged around a pass line for the material being worked, the axes of the rolls being inclined so that the shaft ends on the material inlet side of the rolls are at a cross angle $\gamma$ from the pass line, said axes being inclined at a feed angle $\beta$ so that the shaft ends on same side of the rolls face the same circumferential side of the material being worked, said rolls being supported at their respective both ends, and said cross and feed angles being within the following ranges:

$$0° < \gamma < 15°$$

$$3° < \beta < 20°$$

$$5° < \gamma + \beta < 30°.$$

2. A method as set forth in claim 1, wherein said bar-form material is a cast material produced by a continuous casting machine.

3. A method as set forth in claim 1, wherein said bar-form material is produced by forging of an ingot.

4. A method as set forth in claim 1, wherein said bar-form material is produced in a blooming step.

5. A method as set forth in either one of claims 2 or claim 3, wherein said step of elongating the same material is a blooming step.

6. A method as set forth in any one of claims 2, 3 or 4, wherein said step of elongating the said material is a rough rolling step for bar or rod manufacture.

7. A method as set forth in any one of claims 2 or 3, wherein said step of elongating the said material is a rolling step for bar manufacture.

8. A method of manufacturing metallic bar or rod having a circular cross-section which comprises the steps of producing a solid bar-form material having a cross-section which is circular or a polygon of six or more sides and thereafter elongating the said material into a circular cross-sectional bar or rod of reduced diameter by working said material in a rotary mill, said rotary mill comprising three or four rolls adapted to rotate on their respective shafts and disposed in a housing adapted to rotate around a pass line for the material being worked, the axes of the rolls being inclined so that the shaft ends on the material inlet side of the rolls are at a cross angle $\gamma$ from the pass line, said axes being inclined at a feed angle $\beta$ so that the shaft ends on same side of the rolls face the same circumferential side of the material being worked, and said cross and feed angles being within the following ranges:

$$0° < \gamma < 60°$$

$$3° < \beta < 45°.$$

9. A method as set forth in claim 8, wherein said step of producing a bar-form material is a casting step employing a continuous casting machine, and wherein the material produced at said step is supplied to said elongating step without cutting.

10. A method of manufacturing metallic materials having a circular cross section as set forth in claim 9, wherein said elongating step is a blooming step.

11. A method of manufacturing metallic materials having a circular cross section as set forth in claim 9, wherein said elongating step is a rough rolling step for bar manufacturing.

12. A method of manufacturing metallic materials having a circular cross section as set forth in claim 9, wherein said elongating step is a rolling step for rod manufacturing.

13. A method as set forth in claim 8, wherein said step of producing a bar-form material is a rolling step employing a blooming mill and wherein the material produced at said step is supplied to said elongating step without cutting.

14. A method as set forth in claim 8, wherein said step of producing a bar-form material is a rolling step employing a bloom rolling mill and wherein the material produced at said step is supplied to said elongating step without cutting.

* * * * *